US005400759A

United States Patent [19]

Ishida

[11] Patent Number: 5,400,759

[45] Date of Patent: Mar. 28, 1995

[54] FUEL VAPOR PURGE SYSTEM FOR INTERNAL COMBUSTION ENGINE AND METHOD OF DIAGNOSIS THEREOF

[75] Inventor: Yasuhiko Ishida, Himeji, Japan

[73] Assignee: Mitsubishi Denki Kabushiki Kaisha, Tokyo, Japan

[21] Appl. No.: 106,659

[22] Filed: Aug. 16, 1993

[30] Foreign Application Priority Data

Aug. 21, 1992 [JP] Japan ..... 4-222807

[51] Int. Cl.[6] ..... F02M 33/02

[52] U.S. Cl. ..... 123/520; 123/198 D

[58] Field of Search ..... 123/198 D, 520, 518, 123/519, 516, 521

[56] References Cited

U.S. PATENT DOCUMENTS

| | | | |
|---|---|---|---|
| 5,143,035 | 9/1992 | Kayanuma | 123/520 |
| 5,186,153 | 2/1993 | Steinbrenner | 123/198 D |
| 5,193,512 | 3/1993 | Steinbrenner | 123/198 D |
| 5,197,442 | 3/1993 | Blumenstock | 123/198 D |
| 5,220,896 | 6/1993 | Blumenstock | 123/198 D |
| 5,230,319 | 7/1993 | Otsuka | 123/198 D |
| 5,259,353 | 11/1993 | Nakai | 123/520 |
| 5,261,379 | 1/1993 | Lipinski | 123/520 |
| 5,275,144 | 1/1994 | Gross | 123/198 D |
| 5,284,121 | 2/1994 | Abe | 123/198 D |

FOREIGN PATENT DOCUMENTS 190955 3/1989 Japan .

*Primary Examiner*—Carl S. Miller

*Attorney, Agent, or Firm*—Sughrue, Mion, Zinn, Macpeak & Seas

[57] ABSTRACT

A fuel vapor purge system for an internal combustion engine comprises a fuel tank, a purge pipe for introducing fuel vapor generated in the fuel tank into an intake passage of the engine, a purge valve installed in the piping, an engine control unit for opening the purge valve in dependence on the state in which the engine operates, a pressure sensor for detecting a pressure within the fuel tank, and an alarm being operative under the control of the engine control unit. The engine control unit opens the purge valve for a first predetermined period when the engine operation is in a steady state, makes decision as to occurrence of an abnormality in the purge system on the basis of a magnitude of change in the internal pressure of the fuel tank over a second predetermined period covering the first predetermined period, and activates the alarm when occurrence of an abnormality is determined.

10 Claims, 4 Drawing Sheets

FUEL VAPOR PURGE SYSTEM FOR INTERNAL COMBUSTION ENGINE AND METHOD OF DIAGNOSIS THEREOF

BACKGROUND OF THE INVENTION

1. Field of the Invention

The present invention relates to a control apparatus for a fuel vapor purge system of an internal combustion engine of a motor vehicle, which system serves to introduce or purge fuel vapor evaporated from a fuel contained in a fuel tank of the engine into an intake passage thereof so that the fuel vapor is admixed to a fuel supplied from a fuel supply system to undergo combustion within engine cylinders. More particularly, the invention is concerned with a fuel vapor purge system and a diagnosis method with a function for diagnosing the purge system as to the occurrence of a fault, and for generating an alarm upon the detection of an abnormality in the fuel vapor purge system.

2. Description of the Related Art

Heretofore, as in an attempt to prevent the fuel vapor from being discharged to the atmosphere, there have been developed and employed widely fuel vapor purge systems which are designed to purge or introduce the fuel vapor from the fuel tank into the intake passage of the engine by taking into account the operation states thereof.

FIG. 4 is a diagram which shows schematically an arrangement of a fuel vapor purge system disclosed in Japanese Unexamined Patent Publication No. 190955/1989 (JP-A-H1-190955).

Referring to the figure, an internal combustion engine 1 of a motor vehicle is equipped with an intake passage 2 for supplying a fuel air mixture to the engine. To this end, the intake passage 2 is provided with a throttle valve 3 for controlling the intake air flow and a fuel injector (not shown) for injecting fuel supplied from a fuel supply system including the fuel tank 4.

The fuel 5 is contained in a fuel tank 4 which is linked through a pipe 6 to a canister 7. Canister 7 is adapted to absorb the fuel vapor evaporated from the fuel within the fuel tank 4. The canister 7 in turn is linked to the intake passage 2 at a position downstream of the throttle valve 3 through a pipe 8 in which a purge valve 9 is installed. The purge valve 9 is controlled by a signal C outputted from an engine control unit (ECU) 10 in dependence on the engine operation state represented by signals supplied from various sensors known per se and generally denoted by a reference character D.

The pipes 6 and 8 cooperate with the canister 7 and the purge valve 9 to constitute a fuel vapor purge system for introducing or purging the fuel vapor from the fuel tank 4 into the intake passage 2.

The engine 1 is further equipped with an exhaust gas passage (not shown) and various sensors (not shown) for detecting the engine operation state. Further, the engine 1 is provided with a fuel injector for injecting the fuel 5 undergo combustion, as mentioned above. Operation timings for the fuel injector and the ignition system of the engine 1 are under the control of the engine control unit 10.

Next, a description will be made of the operation of the fuel vapor purge system shown in FIG. 4.

The engine control unit 10 controls optimally the fuel injection timing, the ignition timing and other control quantities for the engine 1 in dependence on the operation state thereof and hence the running condition of the motor vehicle. When a driver of the motor vehicle depresses the accelerator pedal, the throttle valve 3 is opened in correspondence to the extent of the depression, to thereby increase the intake air flow, whereby the amount of the fuel mixture as injected increases correspondingly.

On the other hand, the fuel vapor resulting from evaporation of the fuel contained in the fuel tank 4 is absorbed by the canister 7 through the pipe 6. The engine control unit 10 generates the purge valve control signal C in dependence on the engine operation state determined on the basis of the sensor signals D, as a result of which the purge valve 9 is opened to thereby allow the fuel vapor absorbed by the canister 7 to be sucked into the intake passage 2 through the pipe 8 under a negative suction pressure within the passage 2. Thus, the fuel vapor is supplied to the engine 1 along with the fuel mixture through the intake passage 2 to undergo combustion. In this manner, the fuel vapor is prevented from being discharged to the atmosphere.

However, when at least one of the communication pipes 6 and 8 is clogged or choked due to the occurrence of some abnormality, the fuel vapor can no longer be purged satisfactorily into the intake passage 2, resulting in an increase of the internal pressure of the fuel tank 4, which may eventually lead to the leakage of the fuel vapor from the fuel tank 4 to the atmosphere through a fuel inlet port (not shown) of the tank 4. Besides, disconnection, cracking, breakage or other faults in the pipes 6 and 8, the fuel tank 4, the canister 7 and/or the purge valve 9 will provide a cause for the leakage of the fuel vapor to the atmosphere.

In this conjunction, it must be pointed out that the driver can not perceive an abnormal situation in the fuel vapor purge system because the engine operation can be controlled ordinarily or normally notwithstanding the occurrence of such an abnormality. Consequently, the operation of the engine 1 will be continued, whereby a large amount of fuel vapor will uncontrollably be discharged to the atmosphere.

As will be appreciated from the above description, the fuel vapor purge system known heretofore suffers a problem that the fuel vapor may continue to be discharged to the atmosphere upon the occurrence of an abnormality in the system. This is because the system is not imparted with an abnormality diagnosis capability or function.

SUMMARY OF THE INVENTION

In the light of the state of the art, it is an object of the present invention to solve the problem of the fuel vapor purge system of the engine known heretofore.

More specifically, an object of the present invention is to provide a fuel vapor purge system for an internal combustion engine and a method of diagnosis which can perform an abnormality diagnosis to detect an abnormality in the system and inform the driver or operator of the occurrence of an abnormality in the fuel vapor purge system to thereby prevent the discharge of the fuel vapor to the atmosphere at an earliest stage.

In view of the above and other objects which will become apparent as description the proceeds, there is provided, according to one aspect of the invention, a fuel vapor purge system for an internal combustion engine which comprises a fuel supply means having a fuel tank, a pipe means for introducing or purging fuel vapor generated within the fuel tank into an intake passage of the engine, a purge valve means installed in the conduit means, an engine control unit for opening the purge valve means in dependence on an operation state of the engine, a pressure sensor means for detecting a pressure within the fuel tank, and an alarm means adapted to be activated under the control of the engine control unit. The engine control unit includes means for opening the purge valve for a first predetermined time span when the engine operation is in a steady state, means for making decision as to occurrence of an abnormality in the fuel vapor purge system on the basis of the magnitude of a change in the internal pressure of the fuel tank over a second predetermined period which covers the first predetermined period, and means for activating the alarm means when the occurrence of an abnormality is determined.

According to another aspect of the invention, in a fuel vapor purge system for an internal combustion engine comprising fuel supply means including a fuel tank, conduit means for purging fuel vapor generated within said fuel tank into an intake passage of said engine, purge valve means installed in said conduit means, pressure sensor means for detecting a pressure within said fuel tank, and purge valve control means for opening said purge valve for a first predetermined period when said engine operates in a steady state, there is provided a method of diagnosing the fuel vapor purge system as to occurrence of an abnormality, the method comprising the steps of: deciding, on the basis of sensor signals indicative of operation states of the engine, whether the engine operates in a steady state; fetching a pressure within the fuel tank from the output of the pressure sensor means when the engine is in the steady state and for storing the pressure as an initial pressure value; opening the purge valve means for a first predetermined period to thereby allow the fuel vapor within the fuel tank to be purged into the intake passage of the engine and subsequently closing the purge valve means to thereby terminate the first predetermined period; determining differences between the initial pressure value and pressures within the fuel tank detected at a plurality of successive discrete time points, respectively, during a second predetermined period which starts simultaneously with the start of the first predetermined period and which extends longer than the first predetermined period; a step of determining a cumulative value of the pressure differences; comparing the cumulative value with a preset minimum value indicating normality of the fuel vapor purge system; deciding that the fuel vapor purge system suffers abnormality when the cumulative value is smaller than the preset minimum value; and activating the alarm means when the cumulative value is smaller than the preset minimum value.

The present invention relies on the fact that a change in the internal pressure of the fuel tank upon opening of the purge valve is small when an abnormality such as clogging, leakage or the like fault takes place in the fuel vapor purge system. Accordingly, the magnitude of changes in the pressure within the purge system during the second predetermined period which follows the first predetermined period during which the purge valve is opened is shorter than a predetermined reference value, it can be determined that an abnormality is occurring in the fuel vapor purge system. In that case, the alarm means is activated to inform the driver of such an abnormality of the fuel vapor purge system.

The above and other objects, features and attendant advantages of the present invention will more easily be understood by reading the following description of the preferred embodiments thereof taken, only by way of example, in conjunction with the drawings.

DESCRIPTION OF THE PREFERRED EMBODIMENTS

Now, the present invention will be described in detail in conjunction with preferred or exemplary embodiments thereof by reference to the drawings.

Figure 1:
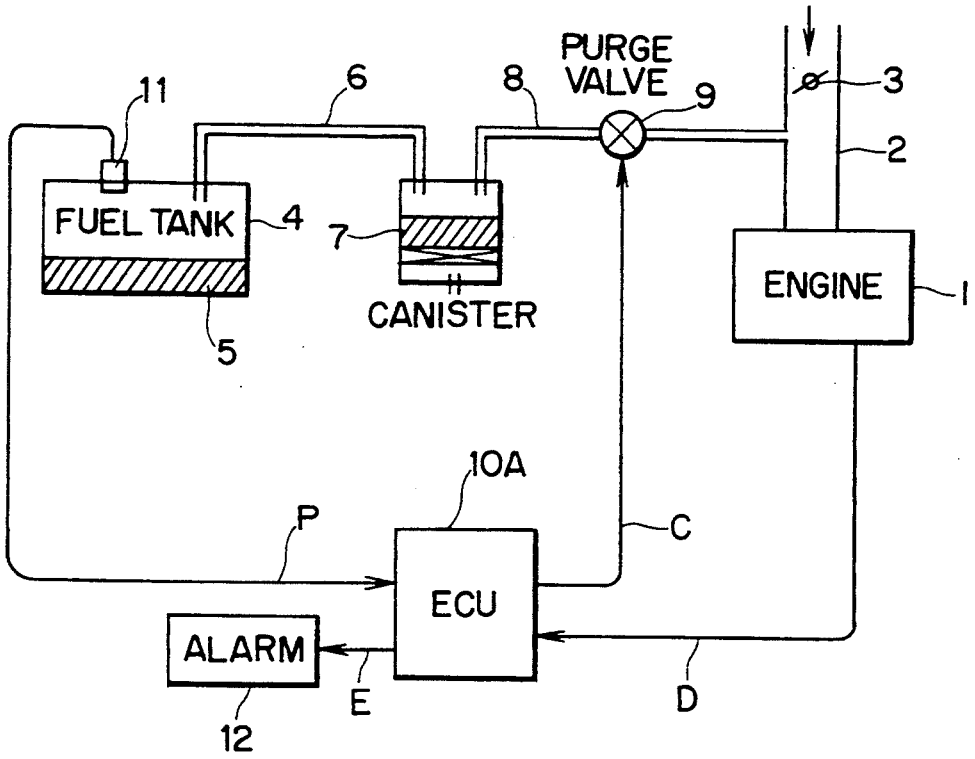
FIG. 1 is a block diagram showing an arrangement of a fuel vapor purge system for an internal combustion engine according to an embodiment of the present invention.
Figure 4:
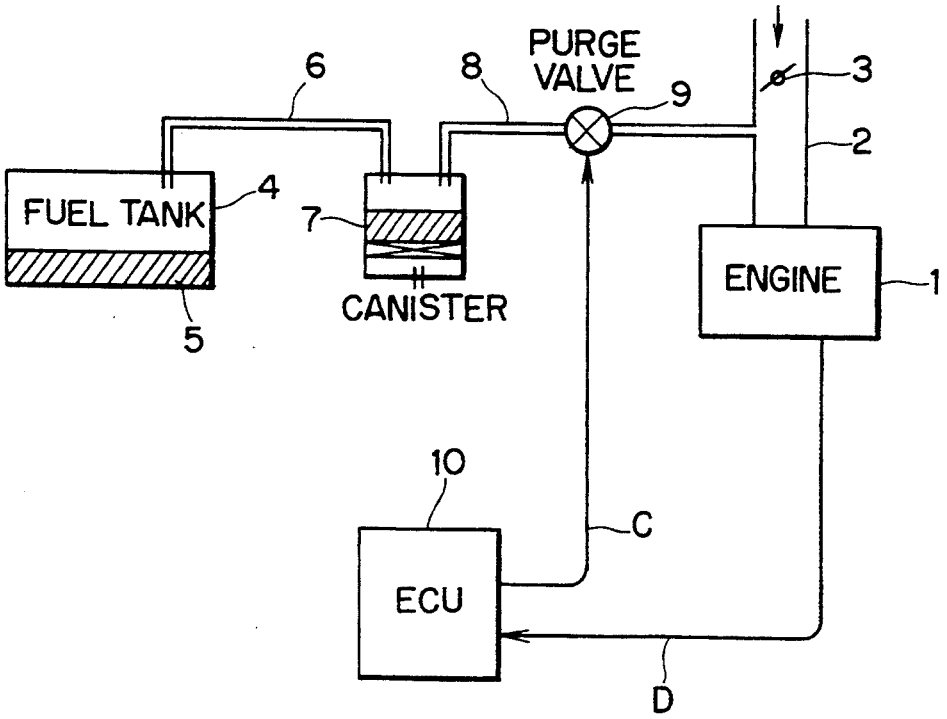
FIG. 4 is a diagram showing schematically an arrangement of a fuel vapor purge system known heretofore.

In FIG. 1 which shows an arrangement of the fuel vapor purge system according to an embodiment of the invention, those components which are same as or equivalent to those of the known system described hereinbefore by reference to FIG. 4 are denoted by like reference numerals and repeated description of these components are omitted. An engine control unit 10A shown in FIG. 1 corresponds to the unit 10 shown in FIG. 4 and may be constituted by a micro-computer including a central processing unit or CPU, a memory for storing programs to be executed by the CPU, a work area for the CPU, input/output interfaces for receiving the sensor signals and outputting the control signals to the fuel injection system, ignition timing control system and others, as is known in the art. In other words, the engine control unit 10A is in charge of overall control of the engine as a whole. Additionally, the control unit 10A according to the embodiment of the invention is provided with a capability or function for diagnosing the fuel vapor purge system as to occurrence of an abnormality. Such diagnosis function can be implemented softwarewise by providing only a pressure sensor and an alarm as hardware devices, as described below.

According to the invention, there are provided a pressure sensor 11 within the fuel tank 4 to generate pressure signal P, and an alarm means 12 which is under the control of the engine control unit 10A. The alarm means 12 may be constituted by a lamp activated in response to an abnormality signal E issued by the engine control unit 10A.

The engine control unit 10A is so programmed as to open the purge valve 9 for a first predetermined period when the engine operation state determined on the basis of the sensor signals D is steady. The control unit 10A makes decision as to occurrence of an abnormality in the fuel vapor purge system on the basis of magnitude of the change in the pressure P within the fuel tank 4 over a second predetermined period which covers the first period, to thereby generate an abnormality signal E to activate the alarm means 12 when it is decided that an abnormality is taking place.

Next, by reference to a flow chart of FIG. 2 and a timing chart of FIG. 3 together with FIG. 1, description will be made of the operation of the engine control unit 10A according to the instant embodiment of the invention for detecting an abnormality of the fuel vapor purge system.

Figure 2:
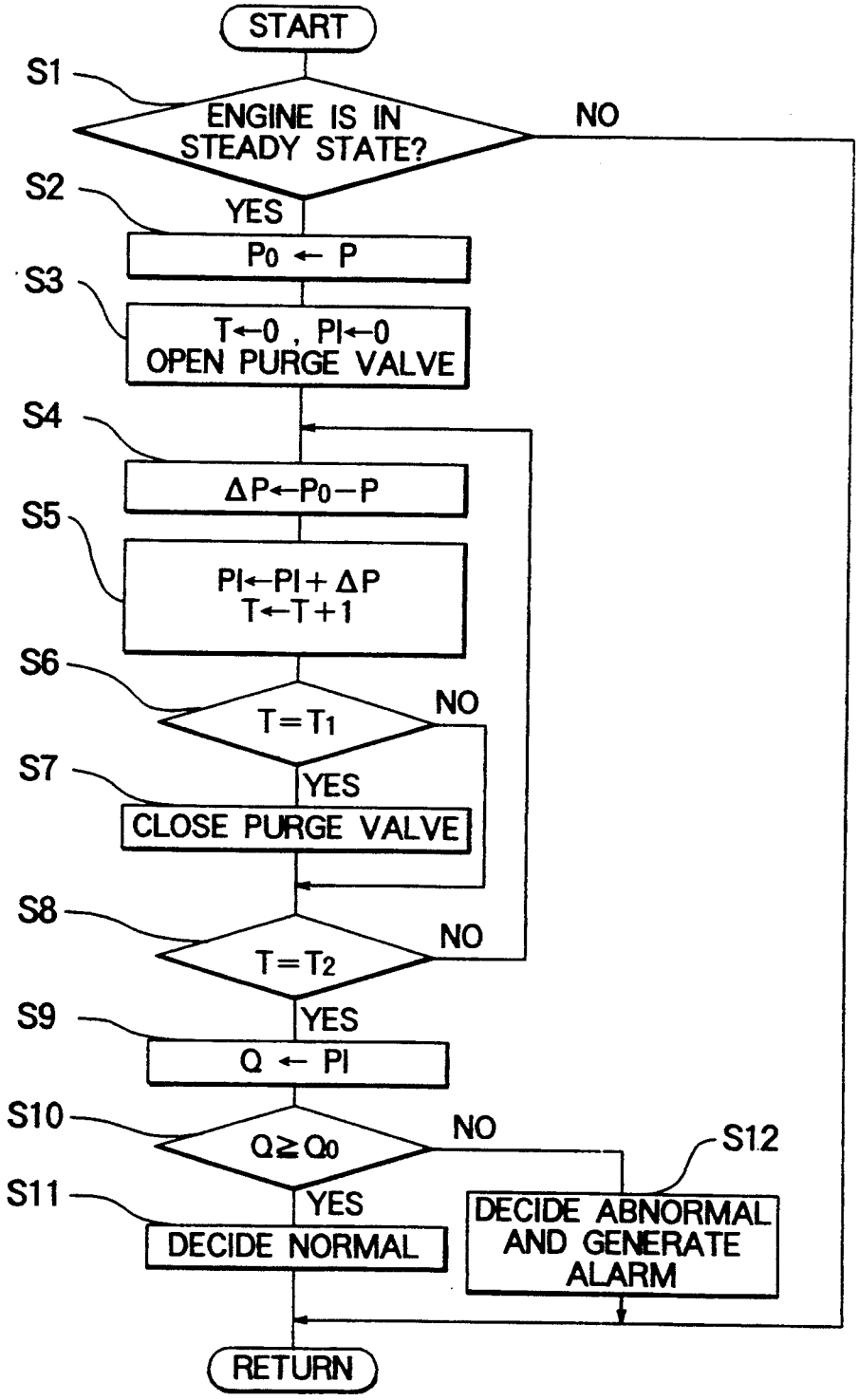
FIG. 2 is a flow chart for illustrating operation of the purge system shown in FIG. 1.

Referring to FIG. 2, in a step S1, the engine operation state is checked on the basis of the sensor signals D as to whether the engine is in a steady state which allows detection of a fault or abnormality in the fuel vapor purge system to be performed. Unless the engine is in the steady state, the processing routine comes to an end (RETURN). On the other hand, when the engine is in the steady state, the pressure P within the fuel tank 4 as detected by the pressure sensor 11 at this time point is stored in the memory of the engine control unit 10A as an initial pressure value $P_o$. Subsequently, in a step S3, contents of a timer counter T and a cumulation counter value PI indicating the magnitude of a change in the pressure within the fuel tank 4 are reset to zero, respectively, to thereby initialize the fuel vapor purge control function of the engine control unit 10A, whereupon the control signal C is generated to open the purge valve 9. In this case, so far as the fuel vapor purge system is normal, the fuel vapor absorbed in the canister 7 is sucked into the intake passage 2 under a negative pressure prevailing within the intake passage 2 (i.e., pressure lower than that within the purge system). Consequently, the pressure P within the fuel tank 4 decreases rapidly (refer to a solid-line curve shown in FIG. 3).

Figure 3:
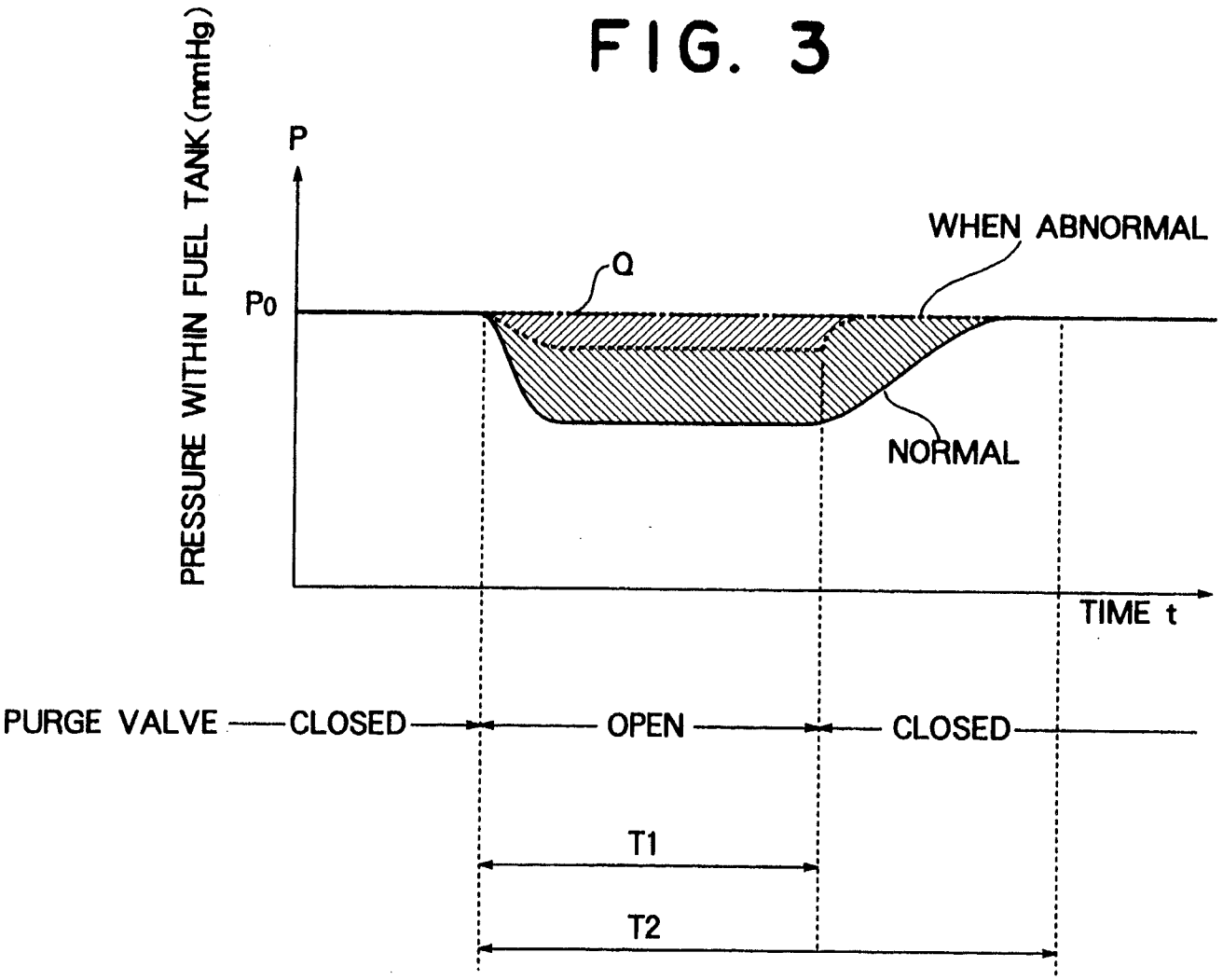
FIG. 3 is a timing chart for illustrating an abnormality diagnosis performed by control unit incorporated in the system shown in FIG. 1.

On the other hand, when a fault or abnormality such as disconnection, cracking or clogging of the pipe 6, 8, and/or the canister 7 takes place in the fuel vapor purge system, the negative pressure within the intake passage 2 is difficult to propagate into the fuel tank 4, as a result of which the pressure P within the fuel tank 4 lowers only gradually, as indicated by a broken line curve in FIG. 3. Disconnection or cracking effects the system because when leakage occurs in the purge system, the ambient air will flow into the purging system when the purge valve is opened. In this state, the pressure within the fuel tank 4 can not sink to the negative pressure within the intake passage 2.

For determining magnitude of change in the pressure P, a pressure difference ΔP at a current time point is detected in a step S4 in accordance with the following expression:

$$\Delta P = P_o - P \quad (1)$$

The pressure differences ΔP as determined is cumulatively added to the cumulation counter value PI stored in the memory. Thus, the cumulation counter value PI is updated to (PI+ΔP), while the time counter T is incremented (a step S5). Subsequently, decision is made in a step S6 as to whether the content of the timer counter T has reached the end of the first predetermined period T1 (i.e., whether the time for closing the purge valve 9 has lapsed). If the timer counter T indicates lapse of the first predetermined period T1, the control signal C is reset, whereby the purge valve 9 is closed (step S7). In that case, the pressure P within the fuel tank 4 can increase only gradually toward a positive pressure due to vaporization of the fuel within the tank 4 (refer to the solid line curves shown in FIG. 3), when the fuel vapor purge system is normal. On the other hand, when the abnormality such as leakage is taking place, the pressure within the fuel tank 4 increases-steeply due to flow-in of the ambient air, as indicated by the broken line curve in FIG. 3.

Next, in a step S8, decision is made as to whether or not the content of the timer counter T has reached the end of the second predetermined period T2 (i.e., whether it is the time for checking the value PI). When the second predetermined period T2 has lapsed, the processing proceeds to a succeeding step S9, and if otherwise, the step S4 is resumed to determine the pressure difference ΔP to update the value PI.

When the decision step S6 results in that the timer counter value T does not indicate the lapse of the first predetermined period T1, the purge valve closing step S7 is skipped to execute the above-mentioned decision step S8. At this juncture, it should be noted that the second predetermined period T2 for checking the cumulation value is set longer than the first predetermined period T1 for opening the purge valve 9. Accordingly, in the step S8, it is decided that $T \neq T2$, whereupon the step S4 is resumed.

In this manner, the pressure difference ΔP is cumulated over the second predetermined period T2 (>T1) which covers the first predetermined period T1, as a result of which a cumulation or integration value PI corresponding to a hatched area Q shown in FIG. 3 is obtained.

In a step S9, the cumulation value PI is stored in terms of the area Q representing the magnitude of a change in the pressure P. The area Q assumes a value smaller when leakage occurs in the purging system than when the purging system is normal. The same holds true in the case where the purge pipe 6 or 8 is clogged.

Next, in a step S10, the area Q is compared with a lower limit value $Q_o$ indicating the normal state of the purging pipe system (6, 7, 8) to thereby decide whether the condition that $Q \geqq Q_o$ is met or not.

When the area Q is equal to or greater than the lower limit value $Q_o$, it is determined that the fuel vapor purge system is normal (step S11), whereupon the processing comes to an end (RETURN). On the other hand, when the area Q is smaller than the lower limit value $Q_o$, it is determined that the purging system (6, 7, 8) suffers an abnormality (fault), whereby the abnormality signal E is generated to activate an alarm means 12 (step S12), and the routine comes to an end (RETURN).

In this manner, the pressure difference ΔP (i.e., difference between the pressure $P_o$ within the fuel tank immediately before the opening of the purge valve 9 and the pressure P within the tank 4 after opening of the purge valve 9) is cumulated over the purging period, which is then followed by comparison of the cumulation value PI or the area Q and the reference value, i.e., the lower limit value $Q_o$ indicating normality of the purge system. When $Q < Q_o$, decision is then made that the purging system (6, 7, 8) suffers abnormality, and the alarm means 12 is activated. In this conjunction, it should be noted that the abnormality decision for the fuel vapor purge system is not made on the basis of the instantaneous value of the pressure difference ΔP but on the basis of the cumulated value thereof. Thus, high reliability can be ensured for the result of the abnormality decision.

By executing repeatedly the purging system abnormality detection routine shown in FIG. 2 in the steady state of engine operation to thereby activate the alarm means 12 immediately upon detection of an abnormality, the driver of the motor vehicle can know the occurrence of an abnormality without any appreciable time lag. Thus, retrofit of the purging system such as exchange of the faulty pipe can promptly be conducted, whereby such an unwanted situation in which the fuel vapor is continuously discharged to the atmosphere can be coped with at an early stage.

Many features and advantages of the present invention are apparent from the foregoing detailed description, and thus it is intended by the appended claims to cover all such features and advantages of the system which fall within the true spirit and scope of the invention. Further, since numerous modifications and combinations will readily occur to those skilled in the art, it is not intended to limit the invention to the exact construction and operation illustrated and described.

By way of example, although diagnosis of the fuel vapor purge system is performed on the basis of the cumulated or integrated value of the pressure differences $\Delta P$ (i.e., by integrating the values $\Delta P$) over the second period T2, such diagnosis may be executed on the basis of the rate of change in the pressure (i.e., by differentiating the change in the pressure) within the fuel tank which make appearance upon opening and closing of the purge valve 9, respectively.

Accordingly, all suitable modifications and equivalents may be resorted to, falling within the spirit and scope of the invention.

It is claimed:

1. A fuel vapor purge system for an internal combustion engine, comprising:

fuel supply means having a fuel tank;

conduit means for purging fuel vapor generated within said fuel tank into an intake passage of said engine;

purge valve means installed in said conduit means; and control means for diagnosing said fuel vapor purge system as to occurrence of an abnormality;

said control means comprising:

pressure sensor means for detecting an internal pressure within said fuel tank;

purge valve control means for opening said purge valve for a first predetermined period when said engine operates in a steady state; and diagnosis means for making decision as to occurrence of an abnormality in said fuel vapor purge system on the integral of the basis of the magnitude of a change in the pressure within said fuel tank over a second predetermined period covering said first predetermined period.

2. A fuel vapor purge system according to claim 1, wherein said fuel vapor purge system suffers abnormality when said integral of the magnitude of change is smaller than a preset minimum value.

3. A fuel vapor purge system according to claim 1, wherein said control means further comprises:

alarm means for generating an alarm signal; and means for activating said alarm means when occurrence of an abnormality is determined.

4. A fuel vapor purge system according to claim 2, wherein said second predetermined period is so selected as to start at the same time as when said first predetermined period starts during which said purge valve is opened, and terminates at such time When the internal pressure within said purge system, which was lowered upon opening of said purge valve means, regains a pressure level which prevailed in said purge system before said opening of said purge valve.

5. A fuel vapor purge system according to claim 2, wherein said integral of the magnitude of change in the pressure is represented by a cumulative value of differences between the pressure within said fuel tank detected before said purge valve means is opened and pressures detected at discrete time points during said second predetermined period.

6. A fuel vapor purge system for an internal combustion engine, comprising:

a fuel supply means having a fuel tank;

conduit means for purging fuel vapor generated within said fuel tank into an intake passage of said engine;

purge valve means installed in said conduit means; and control means for diagnosing said fuel vapor purge system as to occurrence of an abnormality;

said control means comprising:

pressure sensor means for detecting a pressure within said fuel tank;

purge valve control means for opening said purge valve for a first predetermined period when said engine operates in a steady state;

diagnosis means for making decision as to occurrence of an abnormality in said fuel vapor purge system on the basis of the magnitude of a change in the pressure within said fuel tank over a second predetermined period covering said first predetermined period; and wherein said magnitude of change is determined on the basis of a rate of change in the pressure within said purge system brought about by opening said purge valve means and a rate of change in the pressure within said system brought about by closing said purge valve means in succession to said opening of said valve means.

7. A fuel vapor purge system according to claim 2, wherein said purge valve control means and said diagnosis means are implemented as parts of an microcomputer-based engine control unit which is in charge of overall control of operation of said engine.

8. A fuel vapor purge system according to claim 2, further comprising canister means installed at a position upstream of said purge valve means for temporarily holding the fuel vapor when said purge valve means is closed.

9. In a fuel vapor purge system for an internal combustion engine comprising fuel supply means including a fuel tank, conduit means for purging fuel vapor generated within said fuel tank into an intake passage of said engine, purge valve means installed in said conduit means, pressure sensor means for detecting a pressure within said fuel tank, and purge valve control means for opening said purge valve for a first predetermined period when said engine operates in a steady state, a method of diagnosing said fuel vapor purge system as to occurrence of an abnormality and activating an alarm means indicative of the abnormality, said method comprising the steps of:

deciding, on the basis of sensor signals indicative of operation states of said engine, whether said engine operates in a steady state;

fetching a pressure within said fuel tank from the output of said pressure sensor means when said engine is in the steady state and storing said pressure as an initial pressure value;

opening said purge valve means for a first predetermined period to thereby allow the fuel vapor within the fuel tank to be purged into said intake passage of the engine and subsequently closing said purge valve means to thereby terminate said first predetermined period;

determining differences between said initial pressure value and pressures within said fuel tank detected at a plurality of successive discrete time points, respectively, during a second predetermined period which starts simultaneously with the start of said first predetermined period and which extends longer than said first predetermined period;

determining a cumulative value of said pressure differences;

comparing said cumulative value with a preset minimum value indicating normality of said fuel vapor purge system;

deciding that said fuel vapor purge system suffers an abnormality when said cumulative value is smaller than said preset minimum value; and activating said alarm means when said cumulative value is smaller than said preset minimum value.

10. A fuel vapor purge system for an internal combustion engine, comprising:

a fuel supply means having a fuel tank;

conduit means for purging fuel vapor generated within said fuel tank into an intake passage of said engine;

purge valve means installed in said conduit means; and control means for diagnosing said fuel vapor purge system as to occurrence of an abnormality;

said control means comprising:

pressure sensor means for detecting a pressure within said fuel tank;

purge valve control means for opening said purge valve for a first predetermined period when said engine operates in a steady state;

integration means for calculating a cumulative change value defined by the cumulative value of the difference between the detected pressure before the start of said second predetermined period and the pressures detected during said second predetermined period;

rate measuring means for calculating first rate change defined by the rate of change of said pressure brought about by opening said purge valve, and a second rate change defined by the rate of change of said pressure brought about by the closing of said purge valve; and comparing means for comparing the values of said cumulative change, said first rate change and said second rate change with respective predetermined values and using the results of the comparison to determined whether an abnormality exists.

* * * * *